US012733733B2

(12) United States Patent
Koptik et al.

(10) Patent No.: US 12,733,733 B2
(45) Date of Patent: Sep. 15, 2026

(54) FURNITURE OR HOUSEHOLD APPLIANCE ELEMENT

(71) Applicant: PAUL HETTICH GMBH & CO. KG, Kirchlengern (DE)

(72) Inventors: Christian Koptik, Gütersloh (DE); Thomas Schäfer, Kirchlengern (DE); Waldemar Petker, Bünde (DE); Sören Klüter, Bad Oeynhausen (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 148 days.

(21) Appl. No.: 18/843,477

(22) PCT Filed: Mar. 2, 2023

(86) PCT No.: PCT/EP2023/055367
§ 371 (c)(1),
(2) Date: Sep. 3, 2024

(87) PCT Pub. No.: WO2023/166143
PCT Pub. Date: Sep. 7, 2023

(65) Prior Publication Data

US 2025/0185804 A1 Jun. 12, 2025

(30) Foreign Application Priority Data

Mar. 4, 2022 (DE) ..... 10 2022 105 122.6

(51) Int. Cl.
*A47B 49/00* (2006.01)
*A47B 81/00* (2006.01)

(52) U.S. Cl.
CPC ..... *A47B 49/00* (2013.01); *A47B 81/002* (2013.01)

(58) Field of Classification Search
CPC ..... A47B 49/00; A47B 49/004; A47B 49/006; A47B 81/002
See application file for complete search history.

(56) References Cited

U.S. PATENT DOCUMENTS 535,886 A * 3/1895 Brand ..... F04D 25/08 5/96
4,124,262 A * 11/1978 Schill ..... A47B 49/004 312/307

(Continued)

FOREIGN PATENT DOCUMENTS

DE 102017113937 A1 12/2017
DE 112018000909 T5 11/2019

(Continued)

OTHER PUBLICATIONS

International Search Report and Written Opinion mailed Jun. 13, 2023 in related/corresponding International Application No. PCT/EP2023/055369.

(Continued)

*Primary Examiner* — Daniel J Rohrhoff
(74) *Attorney, Agent, or Firm* — PATENT PORTFOLIO BUILDERS PLLC

(57) ABSTRACT

A furniture or household appliance element has a guide bearing arranged between the top support plate and the top plate or between the base support plate and the base plate. The guide bearing has a guide cam track and a guide element guided in the guide cam track and a linear guide with connecting parts which are displaceable relative to one another in a direction of translation. At least one end stop is arranged between the top support plate or the top plate or between the base support plate or the base plate.

15 Claims, 17 Drawing Sheets

(56) References Cited

U.S. PATENT DOCUMENTS

Figure 1:
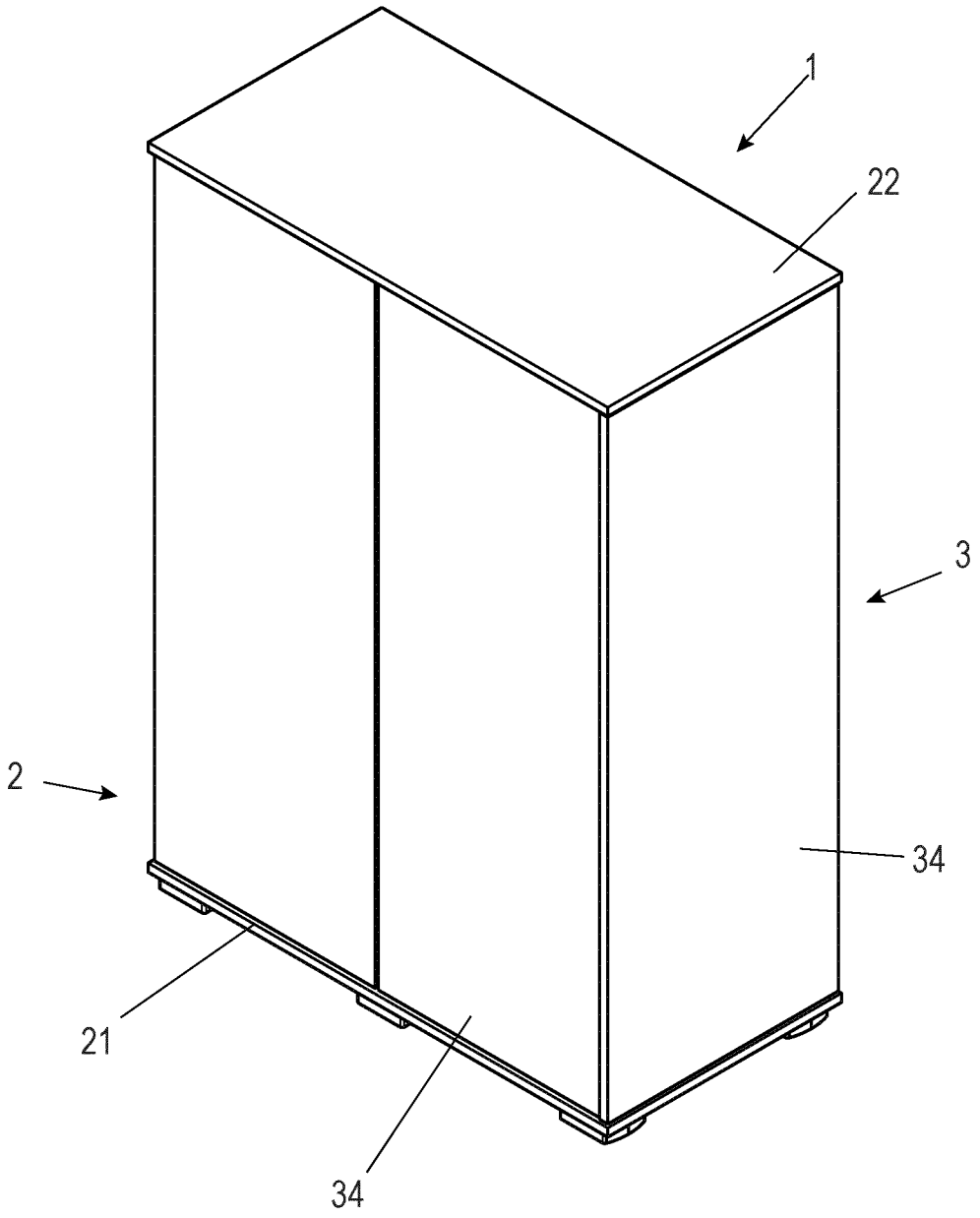

| | | | | |
|---|---|---|---|---|
| 4,191,437 | A | 3/1980 | Funke | |
| 5,813,736 | A * | 9/1998 | Ballew | A47B 96/04 312/348.3 |
| 11,839,297 | B2 | 12/2023 | Rehage et al. | |
| 12,075,911 | B2 * | 9/2024 | Rehage | A47B 96/025 |
| 2017/0184335 | A1 * | 6/2017 | Jeon | F25D 23/02 |
| 2020/0176408 | A1 * | 6/2020 | Lin | H05K 1/111 |
| 2021/0227974 | A1 * | 7/2021 | Rehage | A47B 96/025 |
| 2022/0225763 | A1 * | 7/2022 | Rehage | A47B 49/004 |
| 2024/0115040 | A1 * | 4/2024 | Boekhoff | A47B 49/004 |
| 2024/0415281 | A1 * | 12/2024 | Beumler | A47B 49/004 |
| 2024/0423361 | A1 * | 12/2024 | Nordieker | A47B 49/004 |
| 2025/0288099 | A1 * | 9/2025 | Behrmann | A47B 49/004 |

FOREIGN PATENT DOCUMENTS

| | | | |
|---|---|---|---|
| DE | 102019109866 | A1 | 10/2020 |
| DE | 102019132207 | A1 | 5/2021 |
| DE | 102019132208 | A1 | 5/2021 |
| FR | 2707694 | A1 | 1/1995 |
| JP | H08368 | A | 1/1996 |
| WO | 8801483 | A1 | 3/1988 |
| WO | 2018151123 | A1 | 8/2018 |
| WO | 2020212373 | A1 | 10/2020 |

OTHER PUBLICATIONS

International Search Report and Written Opinion mailed Jun. 7, 2023 in related/corresponding International Application No. PCT/EP2023/055367.

Search Report created Dec. 6, 2022 in related/corresponding DE Application No. 10 2022 105 122.6.

Search Report created Dec. 7, 2022 in related/corresponding DE Application No. 10 2022 105 121.8.

* cited by examiner

FURNITURE OR HOUSEHOLD APPLIANCE ELEMENT

BACKGROUND AND SUMMARY OF THE INVENTION

Exemplary embodiments of the present invention relate to a furniture or household appliance element.

Such furniture or household appliance elements, such as shelves or racks, in which a body part mounted in a carrier body so that it can rotate and move in translation at the same time, are known, for example, from DE 10 2019 109 866 A1.

A translation-rotation bearing is used to perform the translation-rotation movement of the body part.

For stability reasons, it is necessary to provide additional support for the movement of the translational-rotationally movable body section, particularly in the case of larger and/or taller furniture elements.

For this purpose, it is known from DE 10 2019 132 207 A1, for example, to arrange a guide bearing between the top plates of the carrier body and the body part, with which the translational-rotational movement is additionally supported.

Particularly when arranging a translationally and rotationally movable body next to another furniture or household appliance element or close to a wall, it is desirable to precisely define the end positions of the translationally and rotationally movable body part in order to keep the desired distances, in particular the distances between adjacent front surfaces that form joints, constant.

Exemplary embodiments of the present invention are directed to maintaining a predetermined joint pattern with respect to the adjacent body, in particular when a first and second body part are arranged side by side in a furniture or household appliance element in the open and closed position of the translationally and rotationally movable body part.

The furniture or household appliance element according to the invention has a carrier body with a base support plate and a top support plate as well as a body part which is mounted so as to be movable in translation and rotation relative to the carrier body at the same time and has a base plate, a top plate and at least one side wall.

A guide bearing is arranged between the top support plate and the top plate and/or between the base support plate and the base plate.

The guide bearing has at least one guide cam track and a guide element guided in the guide cam track, which are arranged on facing surfaces of the top support plate and the top plate or the base support plate and the base plate.

Furthermore, the guide bearing has a linear guide with connecting parts which can be displaced relative to one another in a direction of translation, one of which is arranged on the top support plate or the top plate and the other of which is mounted on the other of the top support plate or the top plate by means of a pivot bearing and/or one connecting part is arranged on the base support plate or the base plate and the other is mounted on the other of the base support plate or the base plate by means of a pivot bearing.

At least one end stop is arranged between the top support plate or the top plate and/or between the base support plate or the base plate.

By providing such an end stop, the two end positions of the translationally and rotationally movable body part can be precisely defined.

According to an advantageous embodiment, the at least one end stop is arranged on the guide cam track and/or the linear guide.

The assembly of the guide bearing is simplified by the arrangement of such an end stop in the guide cam track and/or linear guide.

According to a further advantageous design variant, the linear guide is formed from a pull-out guide, with a guide rail arranged on the top support plate or the top plates and at least one running rail displaceably mounted thereon, wherein the end stop is arranged on the guide rail, which in one end position of the body part bears against a counter stop on the other of the top support plate or the top plates.

The end stop can be arranged on the linear guide in a simple manner.

The guide rail of the linear guide is preferably mounted on a housing section of the guide cam track so that it can rotate about an axis of rotation perpendicular to the top support plate or the top plate.

This facilitates the assembly of the guide bearing as a whole by predetermining the position of the axis of rotation on the housing section of the guide cam track.

According to a further advantageous further development, the guide cam track is connected to the top plate of the body part and the at least one running rail of the linear guide is connected to the top support plate of the carrier body.

In a further embodiment, a connecting plate is attached to the at least one running rail of the linear guide, on which the guide element projecting into the guide cam track and the counter stop are arranged.

This makes it easy to fix the guide element and the counter stop, which are coupled together via the connecting plate.

According to an advantageous further development, the counter stop is designed as a bent web projecting from the connecting plate in a guide track formed from the guide rail.

In an advantageous embodiment, the end stop is designed as a spring plate strip with a stop surface projecting into the guide track.

The design of the end stop as a spring plate strip also enables the translationally and rotationally movable second body to be moved to a respective overclosing angle and thus enables, for example, the use of a push-to-open function, which requires such a movement to such an overclosing angle to be triggered.

According to a further alternative embodiment, the end stop or a further end stop is arranged at one end of the guide cam track, which rests against the guide element in an end position of the second body.

In a further embodiment, the end stop can be resilient or damped. Alternatively, the end stop can also be designed as a rigid stop.

Furthermore, in an advantageous further development, the end stop has an adjusting element for adjusting the stop position.

According to a preferred design variant, the end stop has a pivoting stop body with a stop head and an actuator holder as well as an adjusting element pivotably arranged on the guide cam track for easy adjustment of the stop body.

Preferably, the end stop also has a securing element attached to the stop body and the guide cam track for even more stable mounting.

According to a further alternative embodiment, the end stop has a stop body that can rotate about an axis of rotation and has an outer contour with at least two stop sections with unequal radial spacing from the axis of rotation in the circumferential direction.

This also makes it easy to adjust the stop position in at least two different stop positions.

In an advantageous further development, the end stop is held rotatably on a holder attached to the guide cam track, with latching elements being provided on the holder and the stop body for positioning the stop body in at least one defined stop position.

The latching elements make it easy to adjust the position of the stop body by touch.

BRIEF DESCRIPTION OF THE DRAWING FIGURES

Figure 2A:
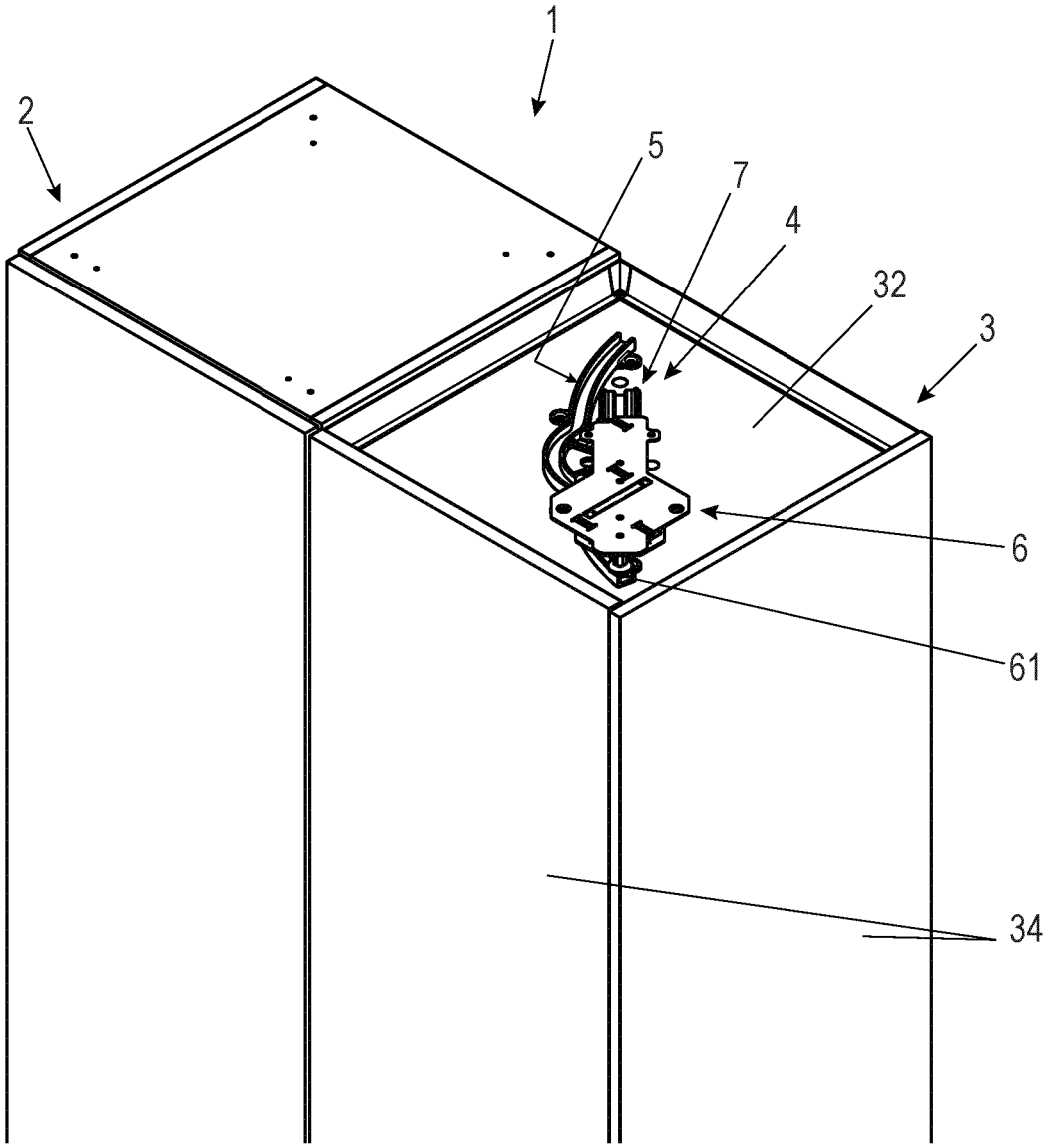
Figure 2B:
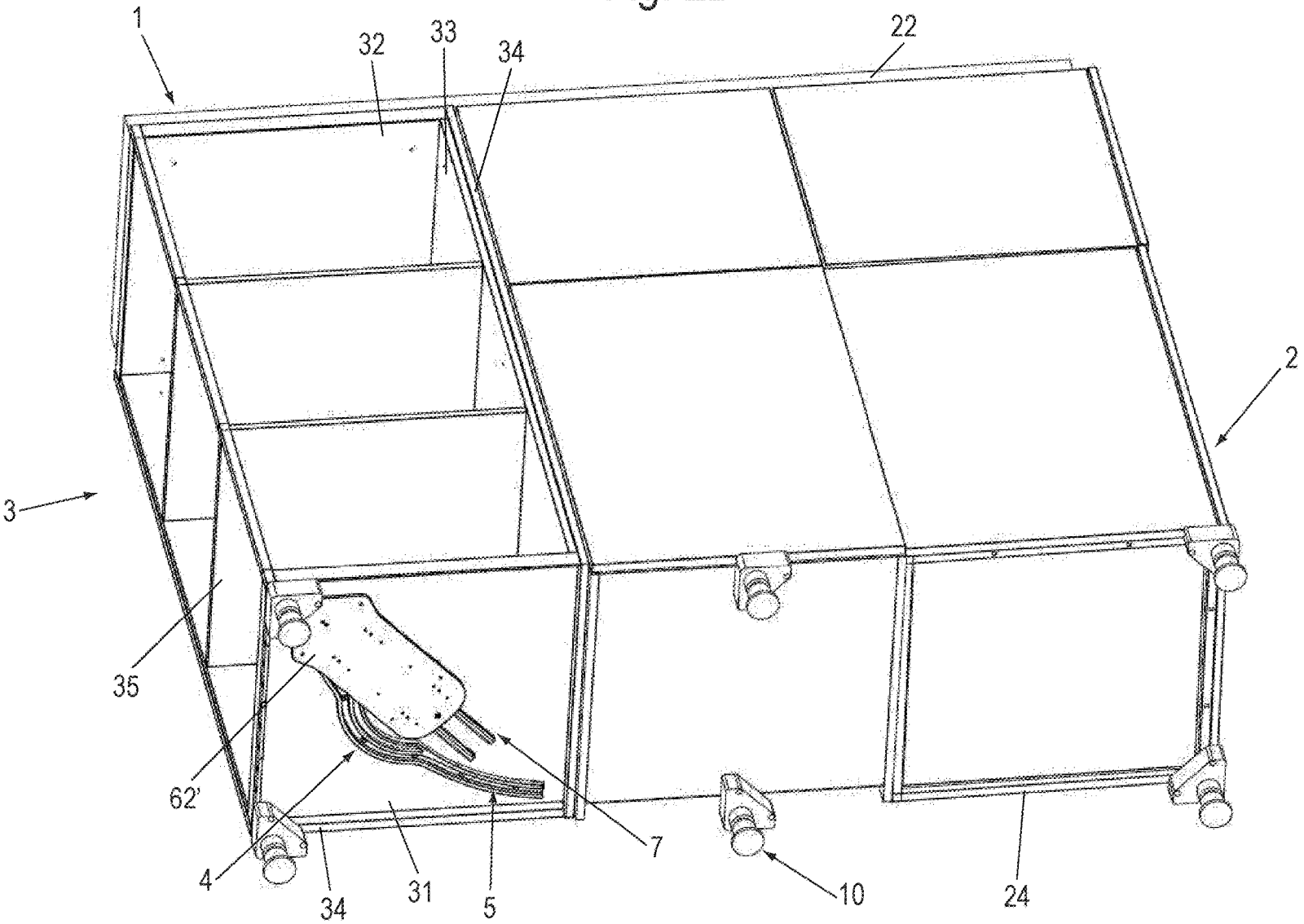
Figure 3:
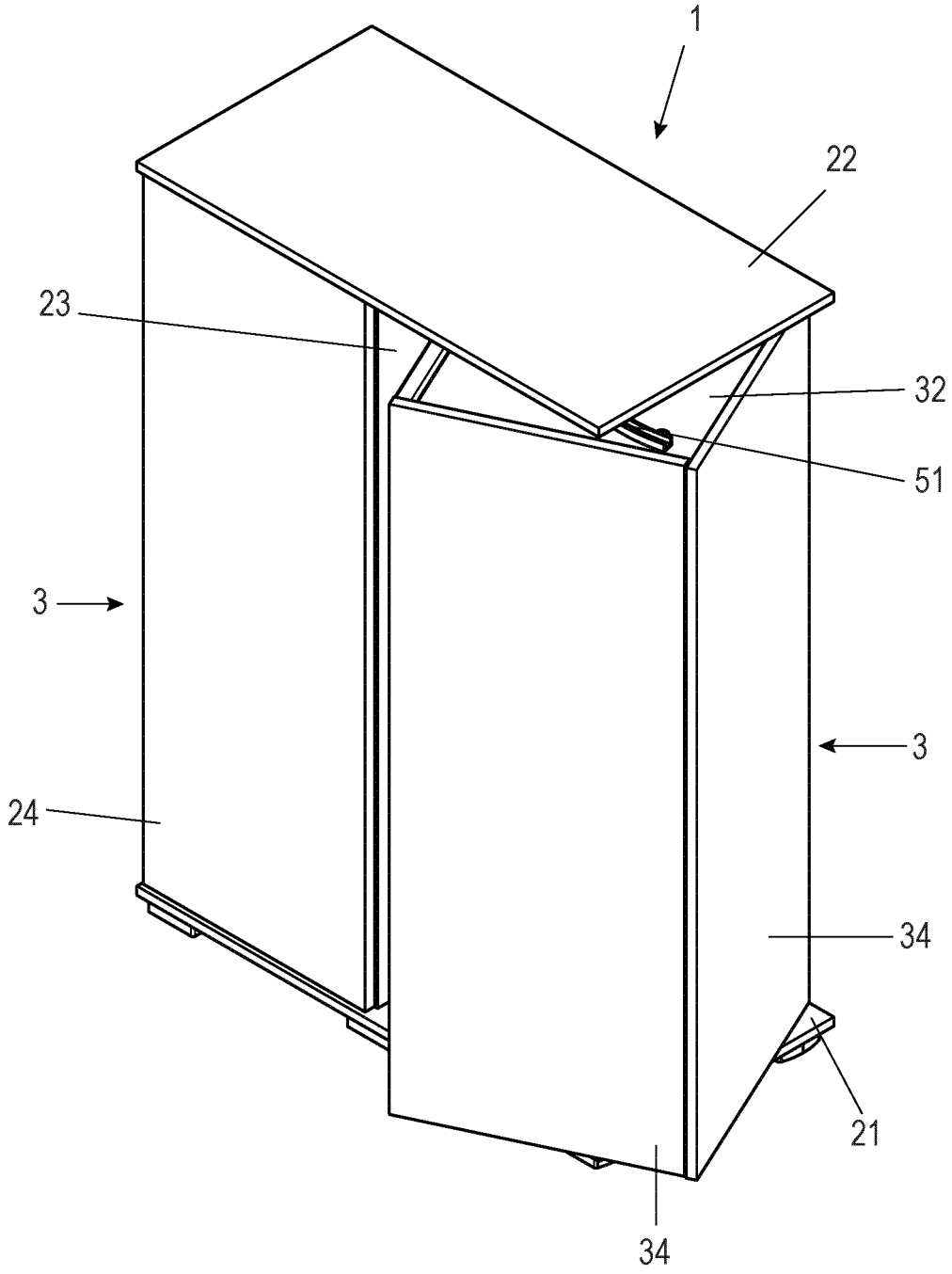
Figure 4:
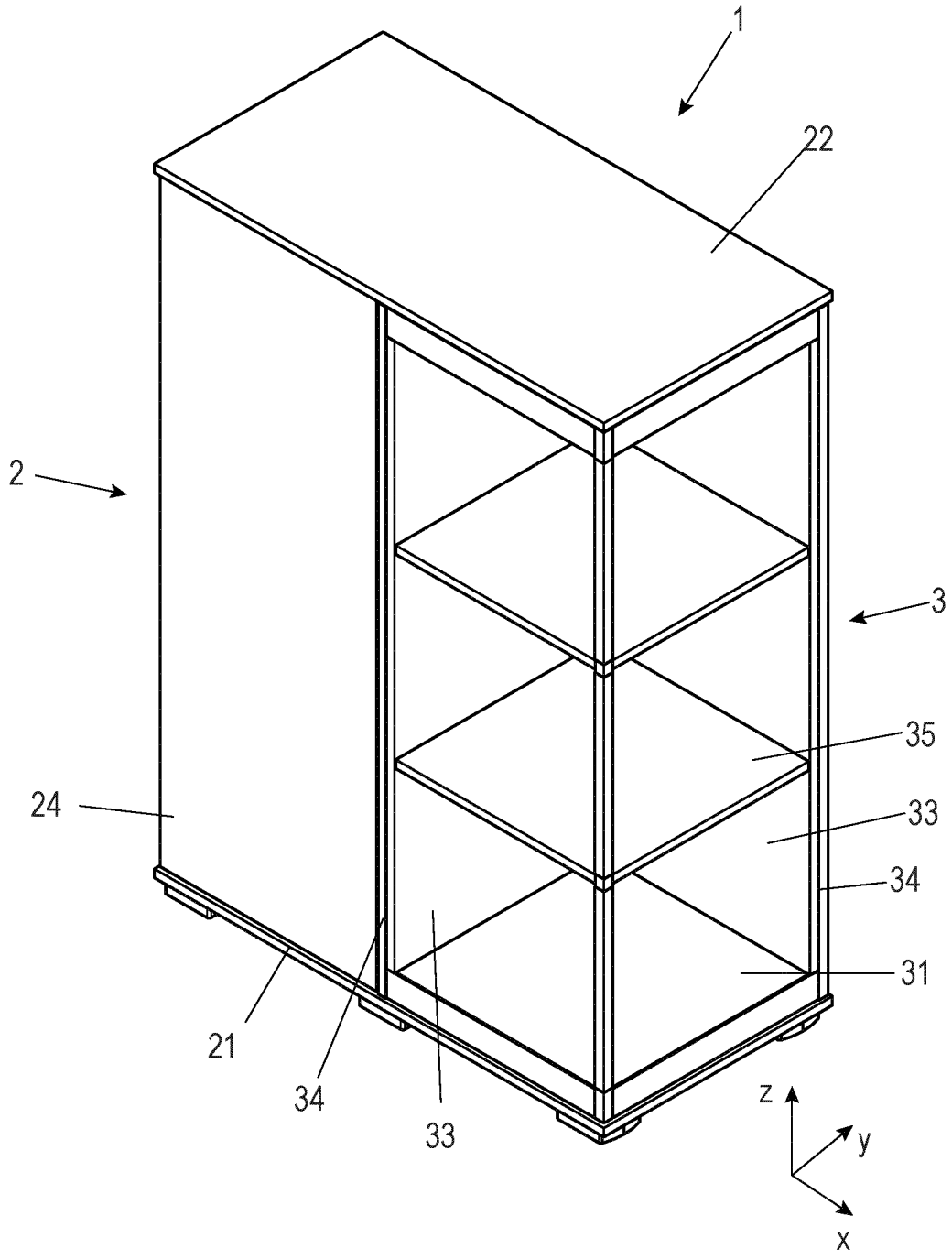
Figure 5:
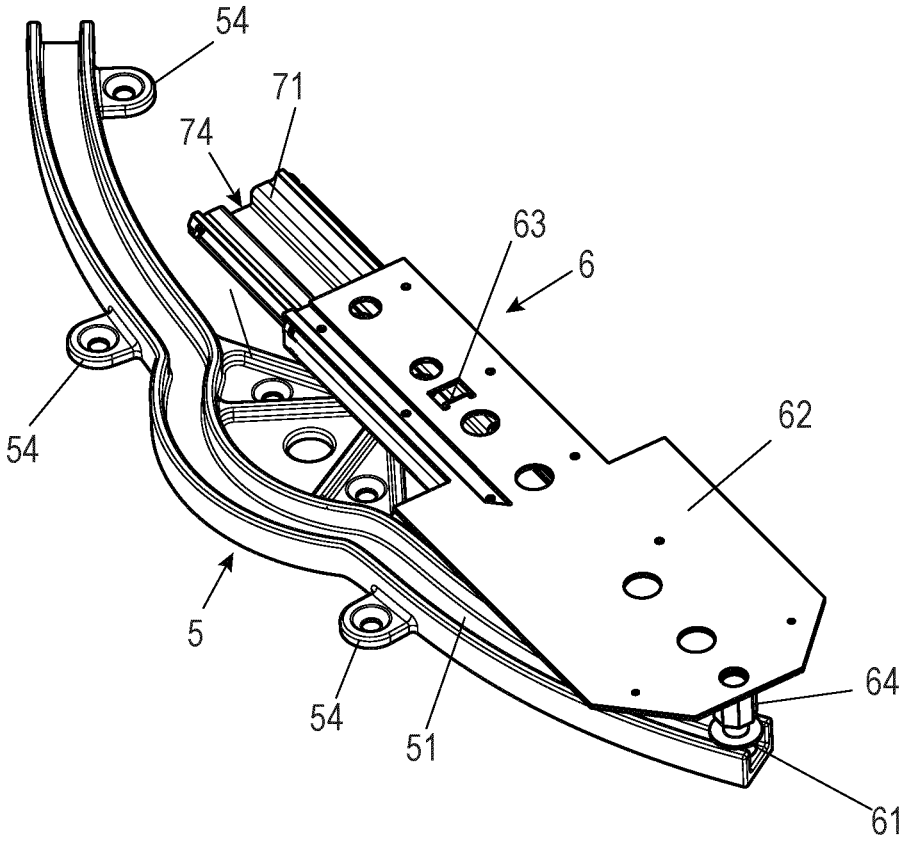
Figure 6:
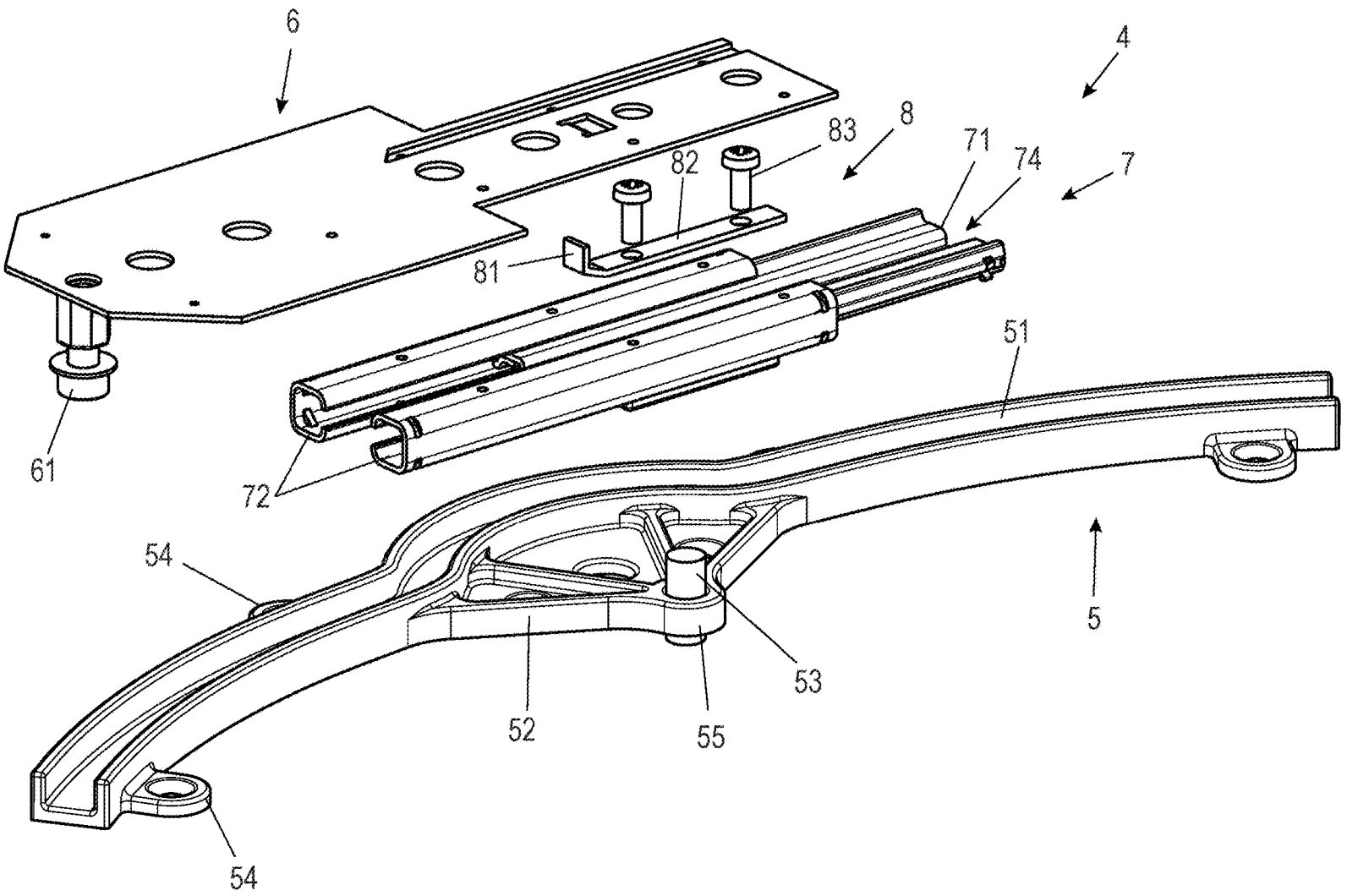
Figure 7:
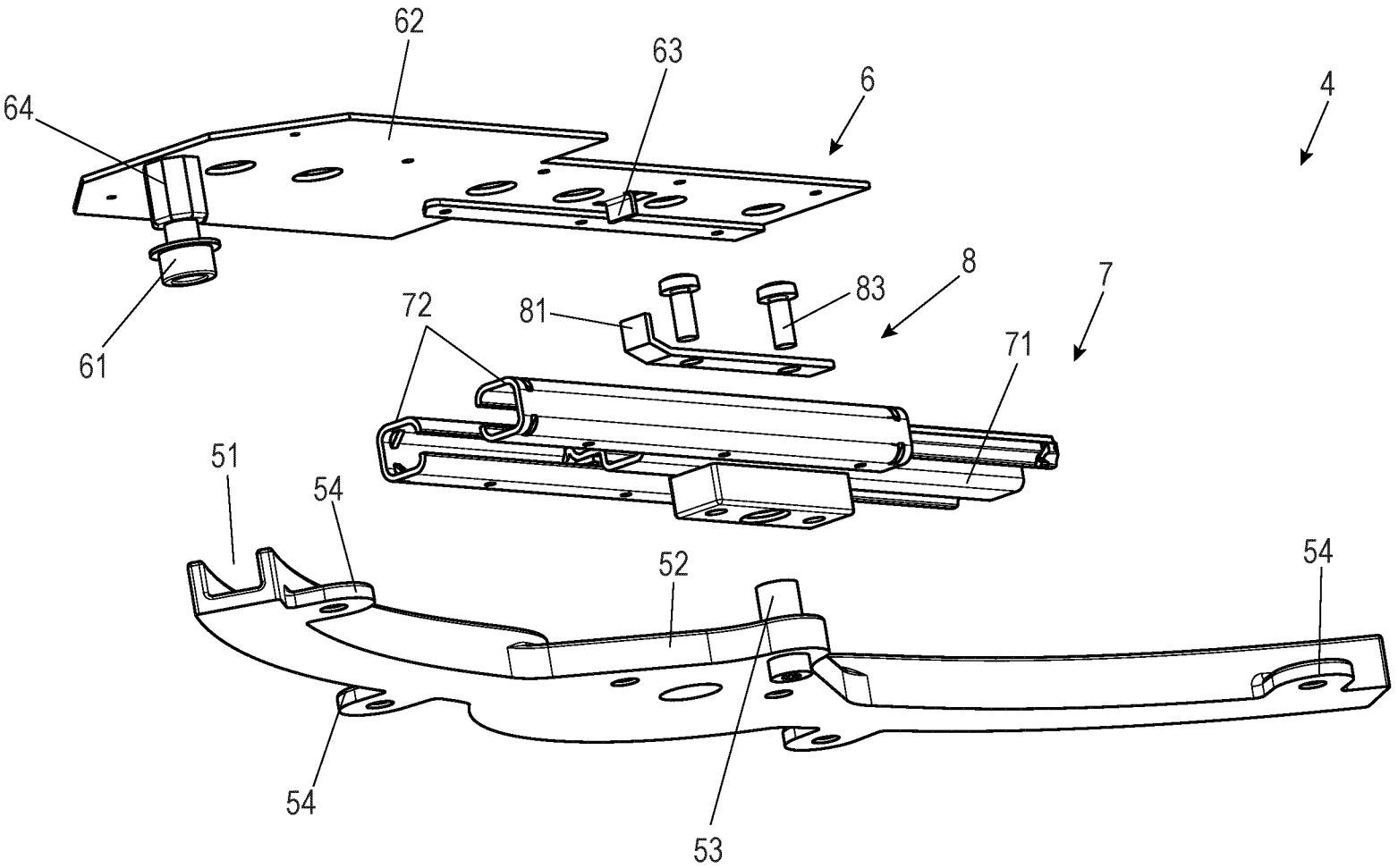
Figure 8:
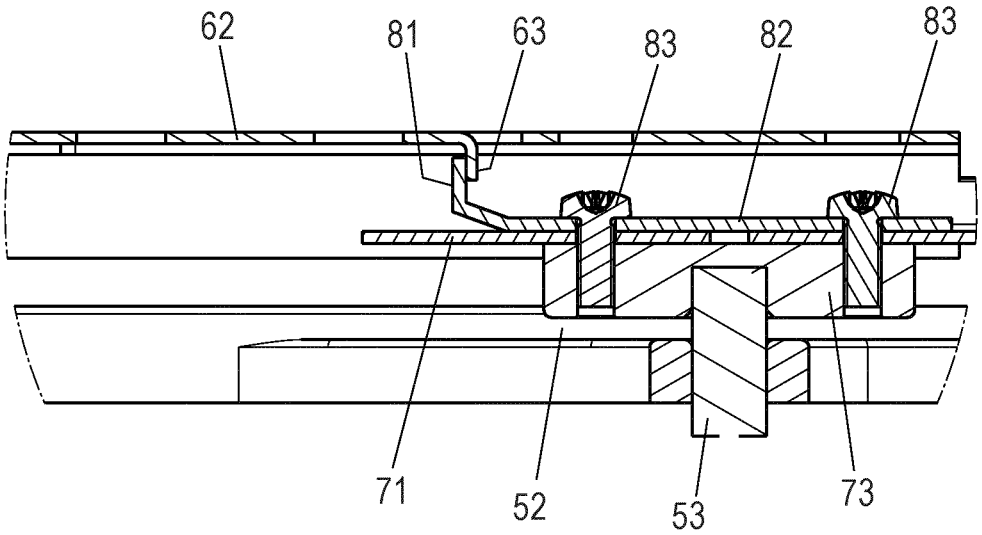
Figure 9:
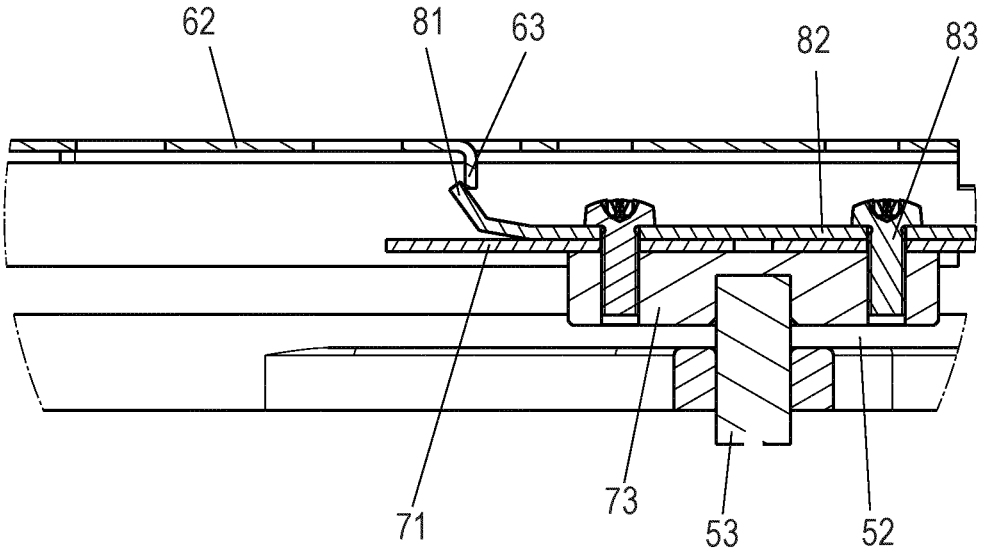
Figure 10:
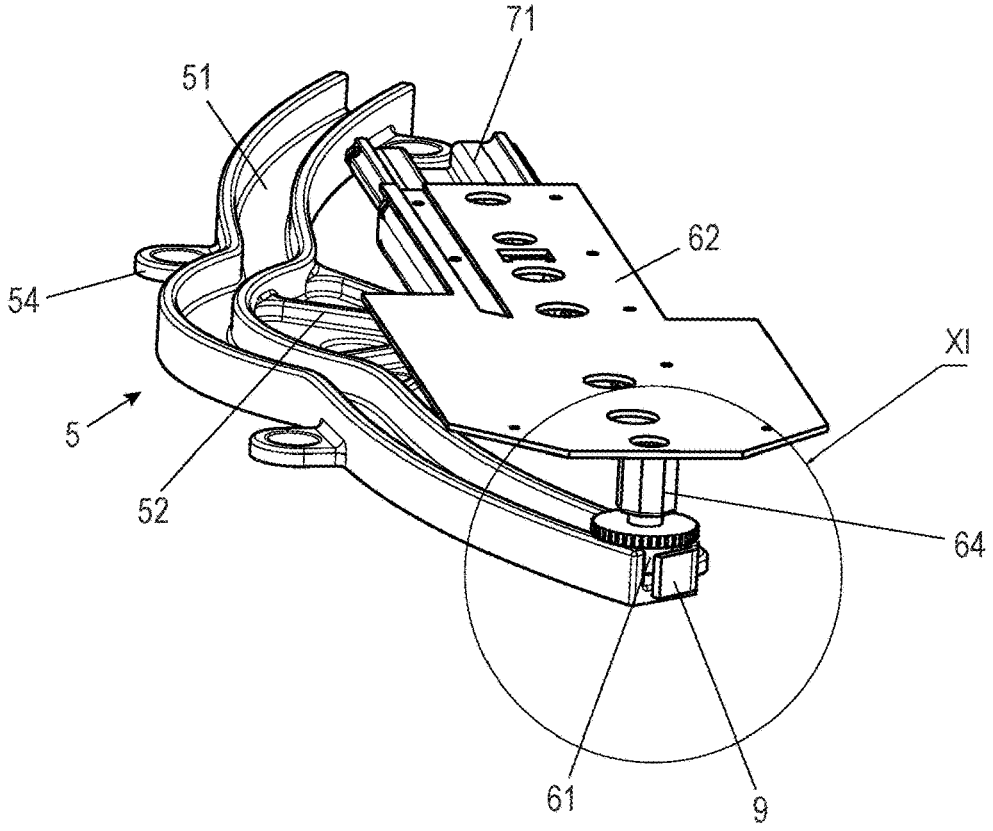
Figure 11:
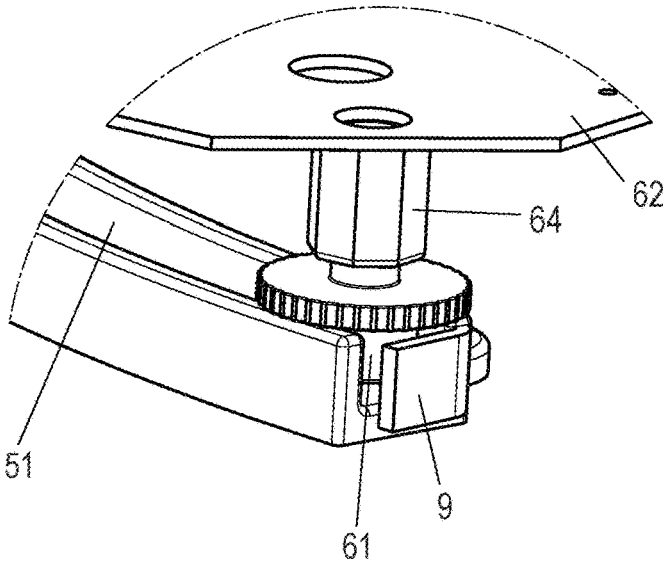
Figure 12:
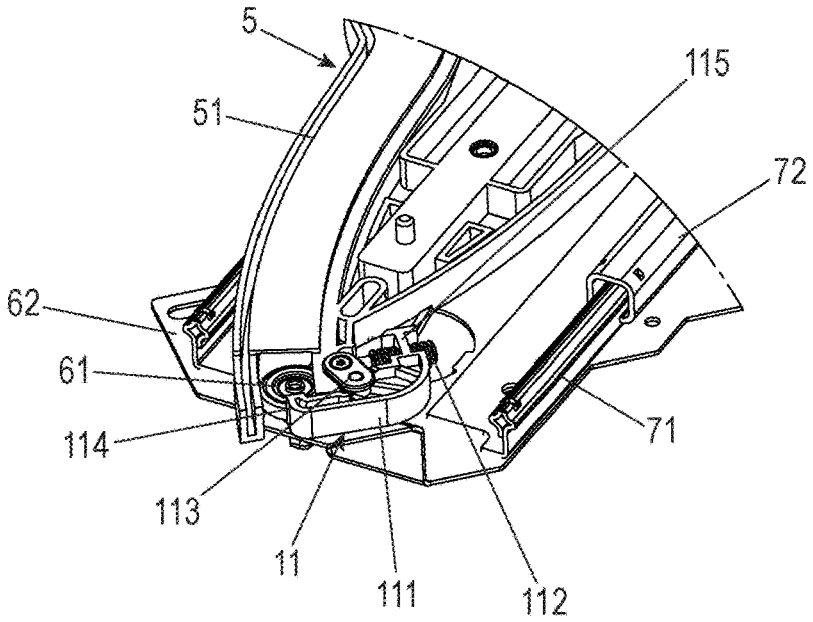
Figure 13:
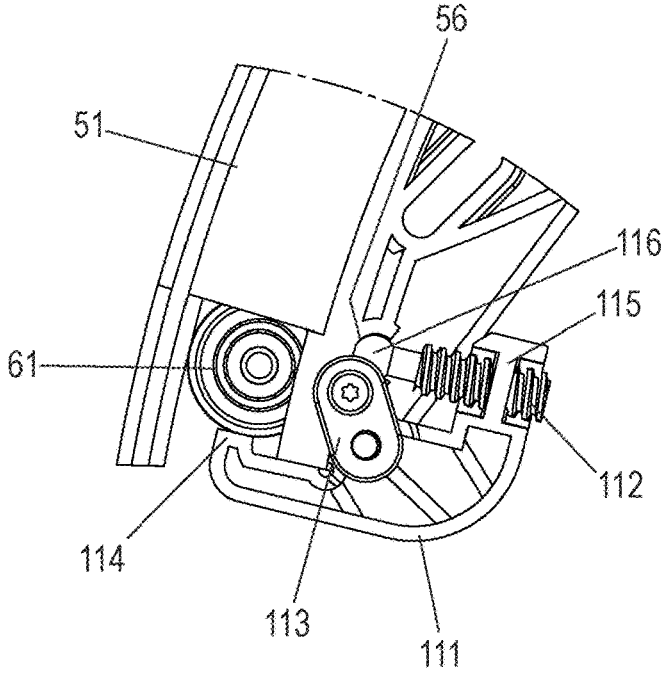
Figure 14:
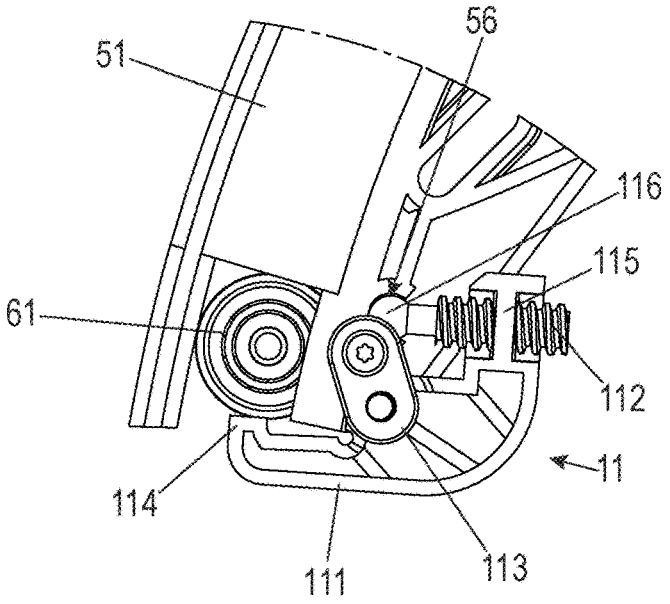
Figure 15:
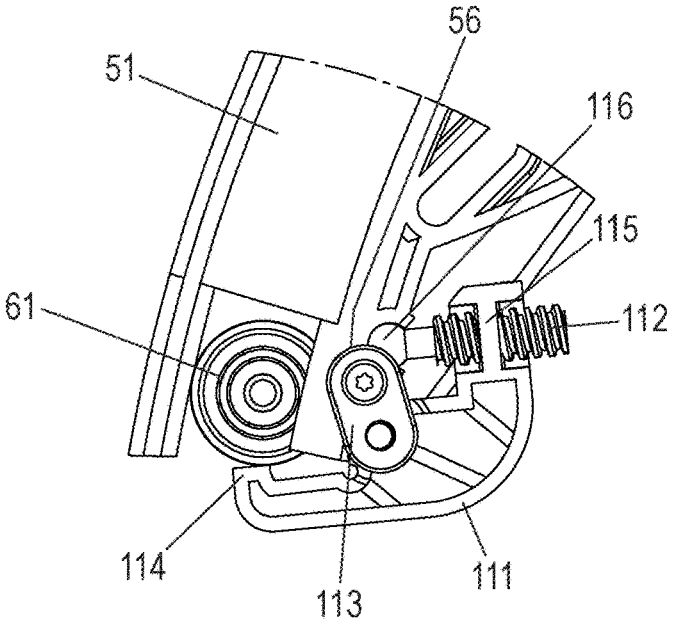
Figure 16:
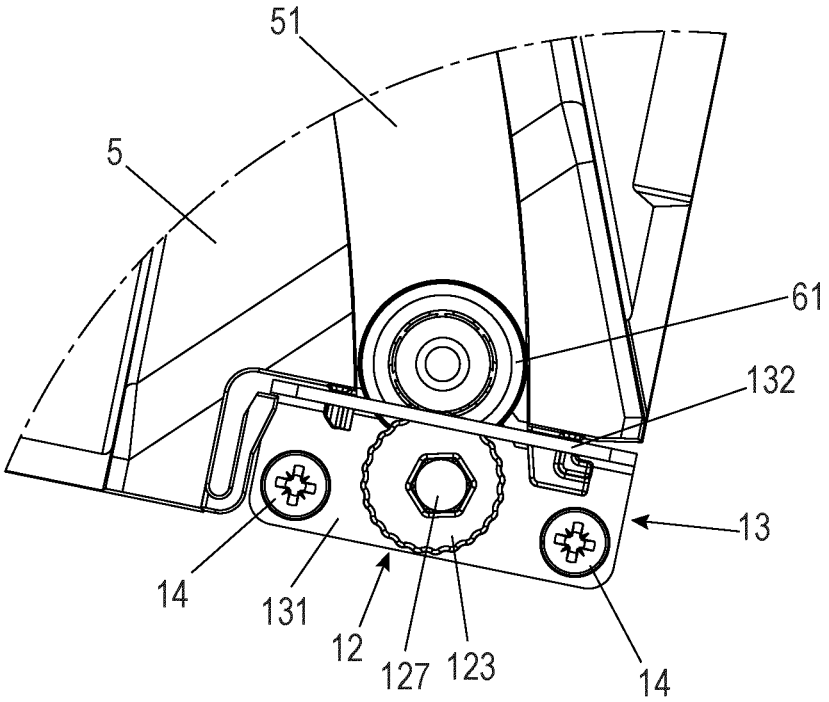
Figure 17:
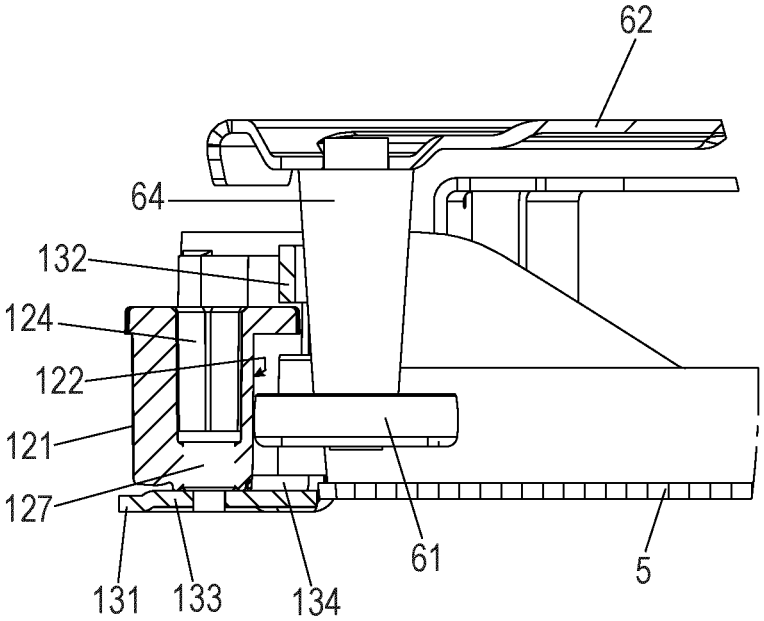
Figure 18:
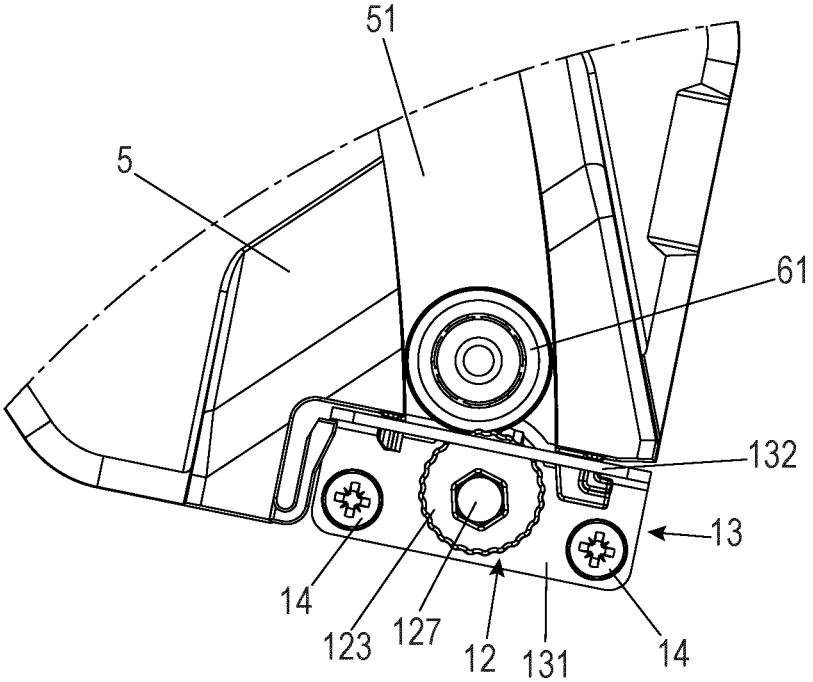
Figure 19:
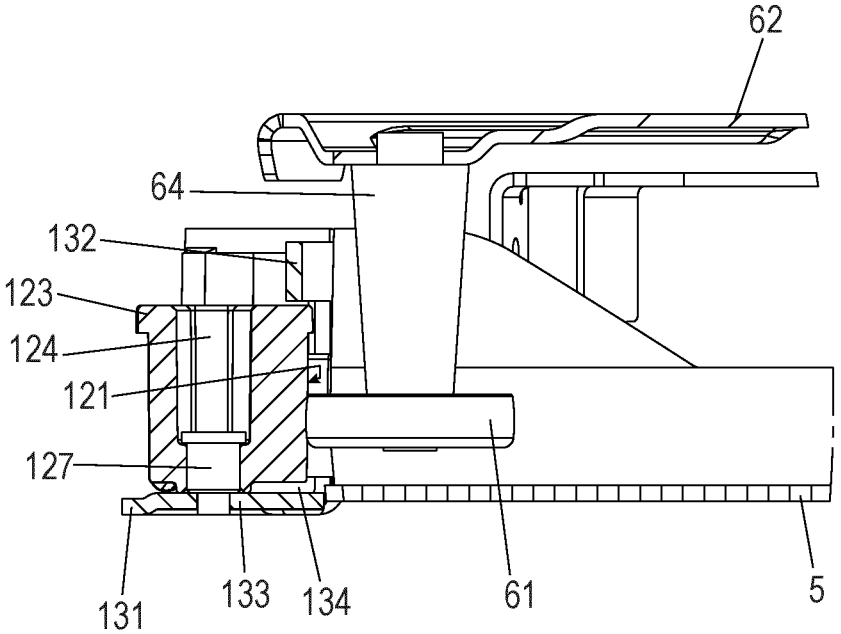
Figure 20:
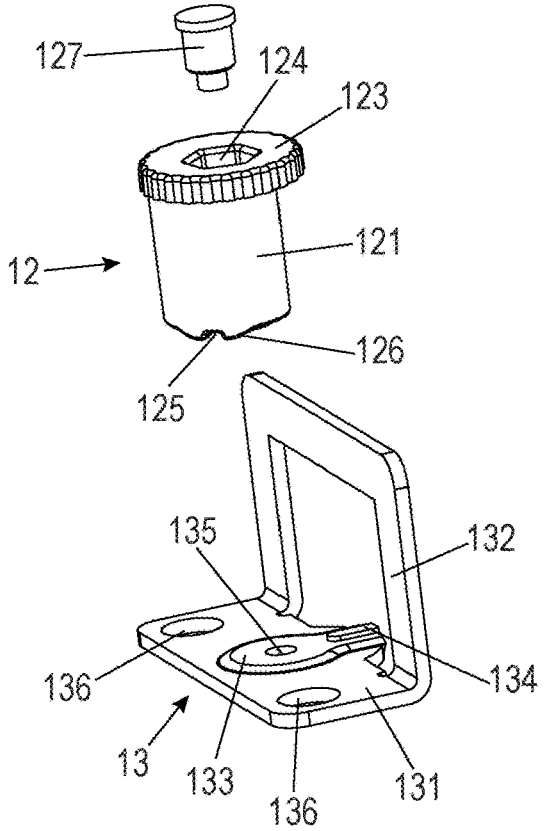
Figure 21:
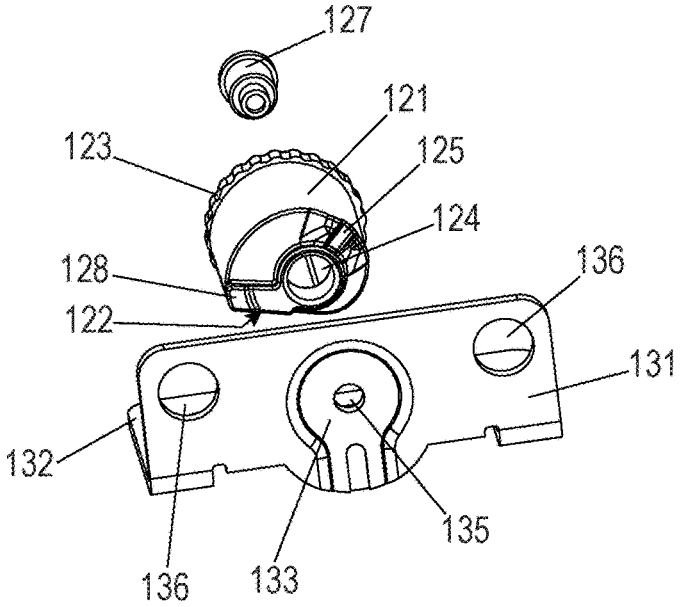
Figure 22:
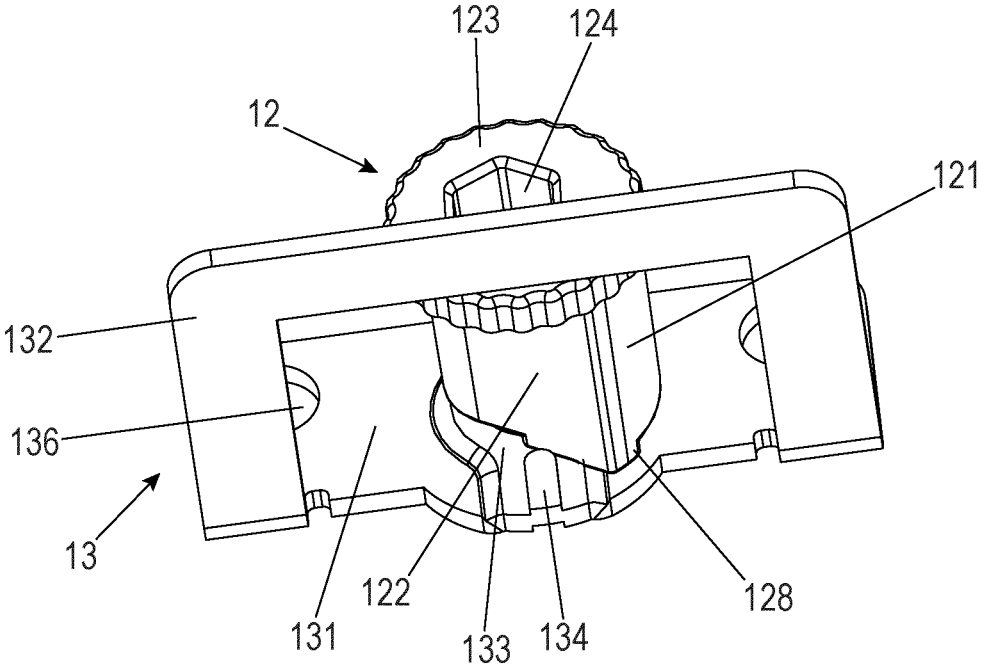
Figure 23:
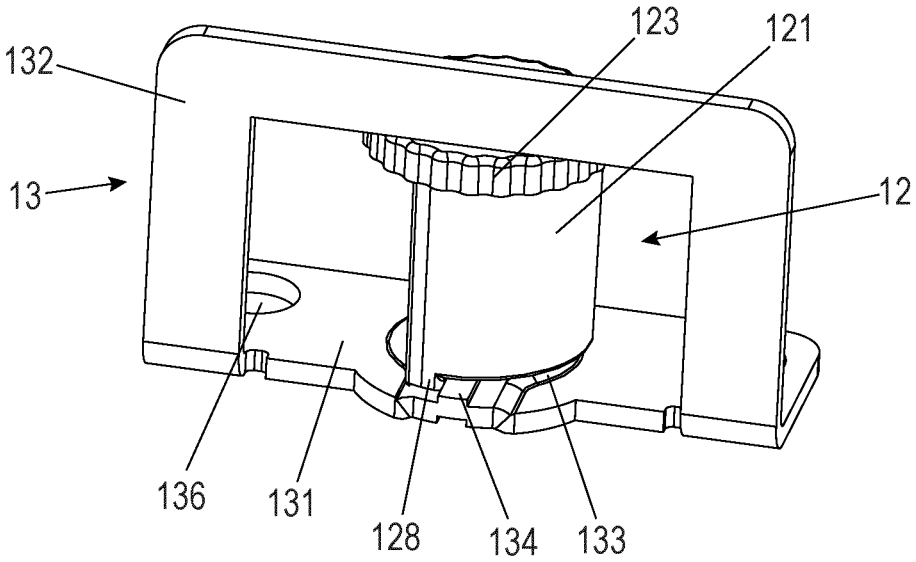
Figure 24:
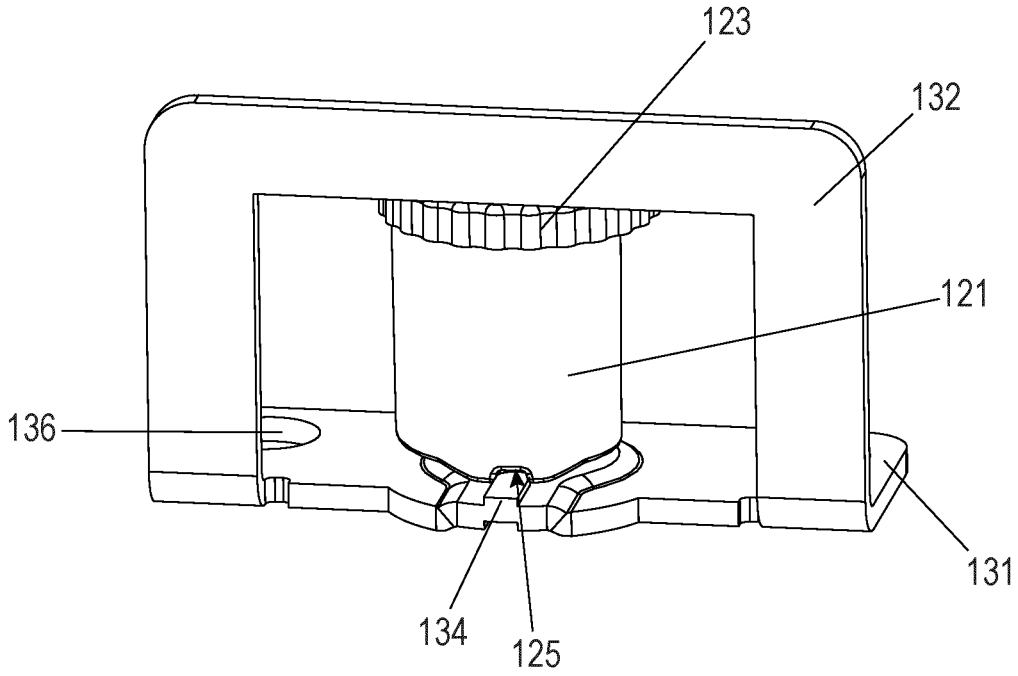
Figure 25:
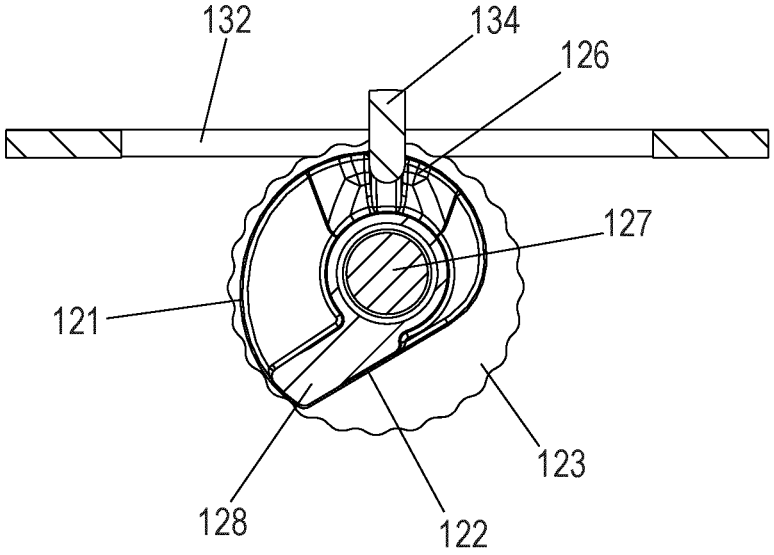

Preferred embodiments are explained in more detail below with reference to the accompanying drawings, wherein:

FIG. 1 shows a schematic perspective view of a furniture element with a first, non-translationally and rotationally movable carrier body and a translationally and rotationally movable body part in the closed position, FIG. 2A shows a representation of the furniture element corresponding to FIG. 1 with the common top support plate removed to show a guide bearing arranged on the top plate, FIG. 2B shows a further view of the furniture element from below with the common base support plate removed to show a guide bearing arranged on the base plate, FIG. 3 shows a representation of the furniture element corresponding to FIG. 1 with the body part moved out of the closed position, FIG. 4 shows a representation of the furniture element corresponding to FIG. 1 with the body part in the open position, FIG. 5 shows a schematic perspective view of a design variant of a guide bearing with guide cam track and linear guide, FIG. 6 shows an exploded view of the guide bearing from a first perspective FIG. 7 shows another exploded view of the guide bearing according to FIG. 5 in a second perspective, FIG. 8 shows a sectional view of a section of the guide bearing according to FIG. 5 in an end position of the body part with end stop and counter stop touching each other, FIG. 9 shows a sectional view corresponding to FIG. 8 with overstretched end stop, in which the body part is moved to an overshoot angle, FIG. 10 shows a schematic perspective view of the guide bearing with alternatively arranged end stop, FIG. 11 shows a detailed perspective view of the area marked XI in FIG. 10, FIG. 12 shows a schematic perspective view of the guide bearing with adjustable end stop, FIGS. 13-15 show top views of the adjustable end stop as shown in FIG. 12 in different positions, FIG. 16 shows a schematic top view of the guide bearing with another alternatively arranged, also adjustable end stop in a first setting position, FIG. 17 shows a side sectional view of the guide bearing according to FIG. 16 to show the first adjustment position, FIGS. 18 and 19 show views corresponding to FIGS. 16 and 17 with the guide bearing and the end stop in a second position, FIGS. 20 and 21 show exploded views of the end stop shown in FIGS. 16 to 19 and a holder holding the end stop, FIGS. 22-24 show schematic perspective views of the end stop and the holder in three different positions, and FIG. 25 shows a sectional view of the end stop and the holder in order to illustrate the latching interaction between the latching means of the components.

DETAILED DESCRIPTION

In the following description of the figures, terms such as top, bottom, left, right, front, rear, etc. refer exclusively to the exemplary representation and position of the furniture element, the carrier body, the body part, the top plate, the guide bearing, the guide cam track, the linear guide and the like selected in the respective figures. These terms are not to be understood restrictively, i.e. these references may change due to different working positions or the mirror-symmetrical design or the like.

In FIGS. 1 to 4, the reference sign 1 is used to designate a variant of a furniture element according to the invention. The furniture or household appliance element 1 has a carrier body 2 and a body part 3 that is mounted so that it can move in translation and rotation at the same time.

The carrier body 2 has at least one base support plate 21 and one top support plate 22, as well as at least one side wall 23 connected to the base support plate 21 and the top support plate 22.

The body part 3 has at least one base plate 31 and one top plate 32, as well as at least one side wall 33 connected to the base plate 31 and the top plate 32.

The base support plate 21 of the carrier body 2 extends over the entire surface of the furniture element 1. The same applies to the top support plate 22, which covers both the upper end of the carrier body 2 and the upper end of the body part 3, as shown in FIG. 1, FIG. 3 and FIG. 4.

As shown in FIG. 2A, a guide bearing 4 is arranged between the top support plate 22 of the carrier body 2 and the top plate 32 of the body part 3. The guide bearing 4 serves to provide additional support for the translational-rotational movement of the body part 3.

As shown in FIG. 2A and in FIGS. 5 to 7, the guide bearing 4 has a guide cam track 5 arranged here on the top plate 32 of the body part 3 and a guide element 61 arranged here on a guide part 6 which is fastened to the top support plate 22 of the carrier body 2 and which projects into the guide cam track 5.

Furthermore, the guide bearing 4 has a linear guide 7 with connecting parts that can be displaced relative to one another, one of which is arranged on the top support plate 22 or the top plate 32 and the other of which is mounted on the other of the top support plate 22 or the top plate 32 by means of a pivot bearing.

When a guide bearing 4 with guide cam track 5 and linear guide 7 is arranged in the base area of the body part 3, as shown in FIG. 2*b*, one connecting part is accordingly arranged on the base support plate 21 or the base plate 31 and the other is mounted on the other of the base support plate 21 or the base plate 31 by means of a pivot bearing.

The guide cam track 5 and/or the linear guide 7 has at least one end stop 8, 9, 11.

In the embodiment of the guide bearing 4 shown in FIGS. 5 to 9, the linear guide 7 is formed from a pull-out guide, with a guide rail 71 arranged on the top plate 32 of the second body 3 and at least one running rail 72 slidably mounted thereon, in the embodiment example shown two running rails 72.

The end stop 8 is arranged here on the guide rail 71 and, in an end position of the second body 3, for example shown in FIGS. 1 and 4, rests against a counter stop 63, which is arranged on the top support plate 22 of the carrier body 2.

In the embodiment shown here, a connecting plate 62 is attached to the running rails 72 of the linear guide 7, which in turn is attached to the top support plate 22 of the first body 2.

The connecting plate 62 of the guide bearing 4 arranged in the base area of the body part 3 is correspondingly attached to the base support plate 21 not shown in FIG. 2B.

Both the counter stop 63 and the guide element 61 are arranged on this connecting plate 62. In the embodiment shown here, the guide element 61 is designed as a wheel mounted to rotate about a vertical axis of rotation.

It is also conceivable that the guide element 61 could be designed as a pin, bolt or ball bearing.

The vertical axis extending in the z-direction is formed here by a bearing axis 64, which is fixed to the connecting plate 62.

The counter stop 63 is designed here as a web bent out in the z-direction from the connecting plate 62 extending in the x-y plane and projecting into a guide track 74 formed on the guide rail 71.

As shown in FIGS. 6 and 7, the guide rail 71 of the linear guide 7 is mounted on a housing section 52 of the guide cam track 5 so as to be rotatable about an axis of rotation 53 perpendicular to the top support plate 22 or the top plate 32 arranged parallel thereto.

The axis of rotation 53 is accommodated in a pivot bearing 55 provided for this purpose in a housing section 52 stabilizing the cam track 51 of the guide cam track 5.

On the underside of the guide rail 71 of the linear guide 7 facing the housing section 52, a pivot bearing 73 with a locating bore for the axis of rotation 53 to pass through is attached.

In the embodiment shown in FIGS. 6 to 9, the end stop 8 is designed as a spring plate strip 82 with a stop surface 81 projecting into the guide track 74 of the guide rail 71.

Due to its design as a spring plate strip 82, the stop surface 81 is elastically bendable and thus enables a defined stop in the end position of the closed position, which is defined as a rotation of 0° from the closed position of the body part 3 relative to the carrier body 2 shown in FIG. 1, as well as in an open position, which corresponds to a rotation of 180° of the body part 3 relative to the carrier body 2, as shown in FIG. 4.

If it is intended to be able to release the body part 3 via a so-called push-to-open mechanism, the end stop 8 provided with the spring plate strip 82 enables the body part 3 to be moved to a so-called overclosing angle, which, for example, enables the body part 3 to be moved to an angular position of −1° or 181°.

Such a position of the body part 3 in this overlap angle is shown as an example in FIG. 9.

As shown here, the design of the end stop 8 as a spring plate strip 82 allows the stop surface 81 to be overstretched.

The spring plate strip 82 is preferably screwed through the guide rail 71 into the pivot bearing 73 or fixed to it via bolts 83, in particular screw bolts.

A further embodiment variant for the arrangement of an end stop 8, 9 is shown in FIGS. 10 and 11.

The structure of the guide bearing 4 here essentially corresponds to that of the embodiment example described with reference to FIGS. 5 to 9.

Here, an end stop 9 is additionally arranged at at least one end of the guide cam track 5, which rests against the guide element 61 in an end position of the body part 3, as shown in FIGS. 10 and 11.

The end stop 9 is designed here as a tongue projecting beyond the open end of the cam track 51.

In a preferred embodiment, this tongue can also be resilient.

It is also conceivable to attach a damping element to one of the top plates 22, 32 in the region of at least one end of the cam track 51, which preferably protrudes a little into the cam track 51 in order to enable a damped running-in of the second body 3 into its end positions.

It is also conceivable to provide the end stop 8, 9, 11 with an adjusting element 112 for adjusting the stop position, as shown by way of example in FIGS. 12 to 15.

Such an adjusting element can, for example, be designed as an adjusting screw with a head designed as a stop, so that the end position can be precisely adjusted depending on the position of the head of the adjusting screw, which is screwed into a hole provided for this purpose in the end stop 9 designed as a tongue.

In the embodiment shown in FIGS. 12 to 15, the end stop 11 has a pivotable stop body 111 with a stop head 114 and an adjusting element receptacle 115 as well as an adjusting element 112 pivotably arranged on the guide cam track 5 for adjusting the stop body 111.

The adjusting element 112 is preferably also designed here as an adjusting screw, with a threaded part and a partially cylindrical head 116 adjoining it, which is accommodated in a pivot bearing 56 of the guide cam track 5 and forms the axis of rotation for the stop body 111 of the end stop 11.

The threaded part of the adjusting element 112 is accommodated in the internally threaded adjusting element receptacle 115 of the stop body 111. By turning the adjusting element 112 about its longitudinal axis, the stop body 111 can be pivoted relative to the pivot bearing 56 in a simple manner.

FIG. 13 shows a stop body 111 with the stop head 114 projecting as far as possible into the cam track 51 of the guide cam track 5.

FIG. 14 shows a position of the stop body 111 pivoted by a small angle, in which the guide element 61 strikes the end stop 11 approximately at the edge of the cam track 51.

FIG. 15 shows an even further pivoted position of the stop body 111, in which the guide element 61 only strikes the end stop 11 on the other side of the edge of the cam track 51.

As can also be seen in FIGS. 12 to 15, the end stop 11 also has a securing element 113 attached to the stop body 111 and to the guide cam track 5. On the one hand, the securing element 113 is pivotably secured to the guide cam track 5 with a screw and is held in a bore of the stop body 111 via a pin protruding from the stop body 111.

A further embodiment of an end stop 12 is shown in FIGS. 16 to 25.

In this embodiment, the end stop 12 has a stop body 121 that can be rotated about an axis of rotation 127. The outer contour of the stop body 121 has at least two stop sections with unequal radial spacing from the axis of rotation 127 in the circumferential direction.

In the embodiment shown here, the outer contour of the stop body 121 is shaped like a cylindrical shell in a first stop section, which merges into a second section designed as a flattened portion 122 while reducing the radius of curvature.

The axis of rotation 127 is aligned eccentrically to the cylindrical-shell-shaped contact section, so that by rotating the end stop 12 about the axis of rotation 127, the lateral surface of the stop body 121, which serves as a stop, causes the guide element 61 to protrude as far as possible from the cam track 51 of the guide cam track 5 in a rotational position shown by way of example in FIG. 17, and in the rotational position shown by way of example in FIG. 19, the stop surface of the stop body 121 protrudes as far as possible into the cam track 51 of the guide cam track 5.

The end stop 12 is preferably held rotatably on a holder 13 attached to the guide cam track 5. Latching elements for positioning the stop body 121 in at least one defined stop position are preferably provided on this holder 13 and on the stop body 121.

As shown in FIGS. 20 and 21, the holder 13 is preferably designed as an L-shaped piece of sheet metal, with a base 131 and a bracket 132 projecting perpendicular to the base 131.

Recesses 136 are provided in the base 131, through which screws 14 can be screwed into the guide cam track 5.

The end stop 12 has an axle mounting 124, in which the axis of rotation 127, which is designed here as a bolt, is accommodated, the bolt serving as axis of rotation 127 preferably being rotatably fixed, in particular riveted, in an axle mounting 135 in the base 131 of the holder 13.

The end stop 12 also has a cylindrical disk-shaped adjusting head 123. The adjusting head 123 is preferably provided with knurling on its lateral surface. This makes it easier to adjust the end stop 12.

In the assembled state, a segment of the adjusting head 123 protrudes under the bracket 132 of the holder 13 in the direction of the cam track 51, as shown in FIGS. 16 and 18.

On an end face of the stop body 121 facing away from the adjusting head 123, a groove 125 is formed between two lips 126 which, together with a web 134 projecting from the base 131 of the holder 13, enables the end stop 12 to be latched in a predetermined rotational position of the stop body 121.

Furthermore, below the section of the stop body 121 formed as a flattened portion 122, a web 128 projecting from the lower end face is formed on the stop body 121, which serves as a stop of respective rotational positions of the end stop 12 at an edge of the elevation 133 of the holder 13, as shown by way of example in FIGS. 22 and 23.

FIGS. 24 and 25 show the latched position of the end stop 12, in which the web 134 is received in the groove 125.

The carrier body 2 can be designed as a body with a top support plate 22, a base support plate 21, a rear wall, and at least one side wall 23. In this case, the top support plate 22 and/or the base support plate 21 can be designed in such a way that more than one body part 3 is arranged between them.

All body parts 3, some of the body parts 3, or only one body part 3 can be mounted so that it can be moved relative to the carrier body 2 via a translation-rotation fitting. Instead of several body parts 3, individual shelves, clothes rails, or drawers can be arranged on the carrier body 2 in parts of the furniture element 1 in addition to the one body part 3 that can be moved relative to the carrier body 2 via a translation/rotation fitting.

Alternatively, the carrier body 2 can also be designed as a wall bracket with a top plate and base plate, for example if the furniture or household appliance element 1 is arranged in a corner or niche of a room.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SYMBOLS

1 Furniture element
2 Carrier body
21 Base support plate
22 Top support plate
23 Side wall
3 Second body
31 Base plate
32 Top plate
33 Side wall
4 Guide bearing
5 Guide cam track
51 Cam track
52 Housing section
53 Axis of rotation
55 Pivot bearing
56 Pivot bearing
6 Guide section
61 Guide element
62 Connecting plate
63 Counter stop
64 Bearing axis
7 Linear guide
71 Guide rail
72 Running rail
73 Pivot bearing
74 Guide track
8 End stop
81 Stop surface
82 Spring plate strip
83 Bolt
9 Final stop
10 Foot
11 End stop
111 Stop body
112 Adjusting element
113 Securing element
114 Stop head
115 Adjusting element receptacle
116 Head
12 End stop
121 Stop body
122 Flattened portion
123 Adjusting head
124 Axle mounting
125 Groove
126 Lip
127 Axis of rotation
128 Web
13 Holder
131 Base
132 Bracket
133 Elevation
134 Web
135 Axle mounting
136 Recess
14 Screw
X Direction
y Direction
Z Direction

The invention claimed is:

1. A furniture or household appliance element comprising:

a carrier body having a base support plate and a top support plate;

a body part mounted to simultaneously translationally and rotationally move relative to the carrier body, wherein the body part has a base plate, a top plate, and at least one side wall;

a guide bearing arranged between the top support plate and the top plate or arranged between the base support plate and the base plate, wherein the guide bearing has at least one guide cam track and a guide element guided in the at least one guide cam track, wherein the at least one guide cam track and the guide element are arranged on mutually facing surfaces of the top support plate and the top plate or on mutually facing surfaces of the base support plate and the base plate, wherein the guide bearing further comprises a linear guide with connecting parts displaceable relative to one another in a direction of translation, wherein one of the connecting parts is arranged on the top support plate or the top plate and another of the connecting parts is mounted on the other of the top support plate or the top plate by a pivot bearing, or the one of the connecting parts is arranged on the base support plate or the base plate and the another of the connecting parts is mounted on the other of the base support plate or the base plate by a pivot bearing; and at least one end stop is arranged between the top support plate and the top plate or between the base support plate and the base plate, wherein the at least one end stop has an adjusting element configured to adjust a stop position.

2. The furniture or household appliance element of claim 1, wherein the at least one end stop is arranged on the at least one guide cam track or on the linear guide.

3. The furniture or household appliance element of claim 1, wherein the linear guide is a pull-out guide with a guide rail arranged on the top support plate or on the top plate and at least one running rail displaceably mounted on the top support plate or on the top plate, wherein the at least one end stop is arranged on the guide rail, wherein in one end position of the body part the at least one end stop bears against a counter stop on the other of the top support plate or the top plate.

4. The furniture or household appliance element of 3, wherein the guide rail of the linear guide is mounted rotatably about an axis of rotation perpendicular to the top support plate or to the top plate on a housing section of the at least one guide cam track.

5. The furniture or household appliance element of claim 3, wherein the at least one guide cam track is connected to the top plate of the body part and the at least one running rail of the linear guide is connected to the top support plate of the carrier body.

6. The furniture or household appliance element of claim 3, further comprising:

a connecting plate, on which the guide element projecting into the at least one guide cam track and the counter stop are arranged, fastened to the at least one running rail of the linear guide.

7. The furniture or household appliance element of claim 6, wherein the counter stop is a web bent out of the connecting plate and projecting into a guide track formed on the guide rail.

8. The furniture or household appliance element of claim 7, wherein the at least one end stop is a spring plate strip with a stop surface projecting into the guide track.

9. The furniture or household appliance element of claim 3, wherein the at least one end stop or a further end stop is arranged at one end of the at least one guide cam track, wherein the at least one end stop or the further end stop abuts against the guide element in an end position of the body part.

10. The furniture or household appliance element of claim 3, wherein the at least one end stop is resilient or damped.

11. The furniture or household appliance element of claim 3, wherein the at least one end stop is a rigid stop.

12. The furniture or household appliance element of claim 1, wherein the at least one end stop has a pivotable stop body with a stop head, an adjusting element receptacle, and an adjusting element that is pivotably arranged on the at least one guide cam track to adjust the pivotable stop body.

13. The furniture or household appliance element of claim 12, wherein the at least one end stop has a securing element fastened to the stop body and to the at least one guide cam track.

14. The furniture or household appliance element of claim 1, wherein the at least one end stop has a stop body that is rotatable about an axis of rotation and has an outer contour with at least two stop sections with unequal radial spacing from the axis of rotation in a circumferential direction.

15. The furniture or household appliance element of claim 14, wherein the at least one end stop is rotatably held on a holder fastened to the at least one guide cam track, wherein latching elements configured to position the stop body in at least one defined stop position are provided on the holder and the stop body.

* * * * *